US009255480B2

(12) United States Patent
Smith et al.

(10) Patent No.: US 9,255,480 B2
(45) Date of Patent: Feb. 9, 2016

(54) TURBINE OF A TURBOMACHINE

(75) Inventors: Paul Kendall Smith, Simpsonville, SC (US); Gunnar Leif Siden, Greenville, SC (US); Craig Allen Bielek, Greenville, SC (US); Thomas William Vandeputte, Scotia, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 895 days.

(21) Appl. No.: 13/284,068

(22) Filed: Oct. 28, 2011

(65) Prior Publication Data

US 2013/0104550 A1 May 2, 2013

(51) Int. Cl.
*F01D 5/14* (2006.01)

(52) U.S. Cl.
CPC ..... *F01D 5/141* (2013.01); *F05D 2240/125* (2013.01); *F05D 2240/307* (2013.01)

(58) Field of Classification Search
CPC ..... F05D 2250/30; F05D 2240/125; F05D 2240/307; F01D 5/141; F01D 5/142; F01D 5/145
USPC ..... 415/191, 192, 194, 193, 195, 914; 416/175, 203
See application file for complete search history.

(56) References Cited

U.S. PATENT DOCUMENTS

| | | | | |
|---|---|---|---|---|
| 891,383 | A | 6/1908 | Steinmetz | |
| 2,392,673 | A | 1/1946 | Hans | |
| 3,635,585 | A | 1/1972 | Metzler, Jr. | |
| 4,194,869 | A | 3/1980 | Corcokios | |
| 4,465,433 | A | 8/1984 | Bischoff | |
| 4,741,667 | A * | 5/1988 | Price et al. | 415/191 |
| 5,326,221 | A * | 7/1994 | Amyot | F01D 5/141 415/181 |
| 5,375,972 | A | 12/1994 | Gray | |
| 5,397,215 | A | 3/1995 | Spear et al. | |
| 5,466,123 | A | 11/1995 | Rose | |
| 5,525,038 | A * | 6/1996 | Sharma et al. | 416/238 |
| 5,575,620 | A * | 11/1996 | Haller et al. | 415/192 |
| 5,581,996 | A | 12/1996 | Koch | |

(Continued)

FOREIGN PATENT DOCUMENTS

| | | | |
|---|---|---|---|
| EP | 1227217 | A2 | 7/2002 |
| EP | 1331360 | A2 * | 7/2003 |

OTHER PUBLICATIONS

Search Report and Written Opinion from corresponding EP Application No. 12189836, dated Jun. 20, 2013.

(Continued)

*Primary Examiner* — Dwayne J White
*Assistant Examiner* — Joshua R Beebe
(74) *Attorney, Agent, or Firm* — Dority & Manning, PA

(57) ABSTRACT

A turbine of a turbomachine is provided and includes opposing endwalls defining a pathway for a fluid flow and a plurality of interleaved blade stages and nozzle stages arranged axially along the pathway. The plurality of the blade stages includes a last blade stage at a downstream end of the pathway and a next-to-last blade stage upstream from the last blade stage. The plurality of the nozzle stages includes a last nozzle stage between the last blade stage and the next-to-last blade stage and a next-to-last nozzle stage upstream from the next-to-last blade stage. At least one of the next-to-last blade stage and the next-to-last nozzle stage includes aerodynamic elements configured to interact with the fluid flow and to define a throat distribution producing a tip strong pressure profile in the fluid flow.

19 Claims, 3 Drawing Sheets

(56) References Cited

U.S. PATENT DOCUMENTS

| | | | | |
|---|---|---|---|---|
| 5,779,443 | A * | 7/1998 | Haller et al. | 415/191 |
| 5,927,946 | A | 7/1999 | Lee | |
| 6,077,036 | A | 6/2000 | Heffron et al. | |
| 6,283,713 | B1 | 9/2001 | Harvey et al. | |
| 6,375,420 | B1 * | 4/2002 | Tanuma et al. | 415/199.5 |
| 6,561,761 | B1 | 5/2003 | Decker et al. | |
| 6,669,445 | B2 | 12/2003 | Staubach et al. | |
| 6,709,223 | B2 | 3/2004 | Walto et al. | |
| 6,969,232 | B2 | 11/2005 | Zess et al. | |
| 7,044,710 | B2 | 5/2006 | Naik et al. | |
| 7,186,074 | B2 | 3/2007 | Blatchford et al. | |
| 7,390,171 | B2 | 6/2008 | Francini | |
| 7,520,728 | B2 | 4/2009 | Sleiman et al. | |
| 7,632,075 | B2 | 12/2009 | Liang et al. | |
| 7,740,449 | B1 | 6/2010 | Brown et al. | |
| 7,887,297 | B2 | 2/2011 | Allen-Bradley et al. | |
| 8,202,039 | B2 | 6/2012 | Guemmer | |
| 8,459,956 | B2 | 6/2013 | Pandey et al. | |
| 2002/0054817 | A1 * | 5/2002 | Tanuma et al. | 416/223 R |
| 2002/0098082 | A1 * | 7/2002 | Ito et al. | 415/191 |
| 2002/0197156 | A1 * | 12/2002 | Haller | 415/192 |
| 2005/0019157 | A1 * | 1/2005 | Tominaga et al. | 415/192 |
| 2006/0120864 | A1 * | 6/2006 | Lu et al. | 415/191 |
| 2006/0140768 | A1 | 6/2006 | Tam et al. | |
| 2006/0222490 | A1 * | 10/2006 | Senoo et al. | 415/191 |
| 2006/0269399 | A1 | 11/2006 | Girgis et al. | |
| 2007/0086891 | A1 * | 4/2007 | Nomura et al. | 415/191 |
| 2007/0224035 | A1 | 9/2007 | Nigmatulin | |
| 2007/0258818 | A1 | 11/2007 | Allen-Bradley et al. | |
| 2008/0050243 | A1 | 2/2008 | Liang | |
| 2008/0175714 | A1 | 7/2008 | Spangler et al. | |
| 2008/0199310 | A1 * | 8/2008 | Nomura et al. | 415/191 |
| 2009/0162193 | A1 * | 6/2009 | Mariotti et al. | 415/191 |
| 2010/0074734 | A1 | 3/2010 | Little | |
| 2010/0158696 | A1 | 6/2010 | Pandey et al. | |
| 2010/0172749 | A1 | 7/2010 | Mitsuhashi et al. | |
| 2010/0254797 | A1 | 10/2010 | Grover et al. | |
| 2010/0284818 | A1 | 11/2010 | Sakamoto et al. | |
| 2010/0300101 | A1 * | 12/2010 | Swintek et al. | 60/685 |
| 2011/0052387 | A1 | 3/2011 | Kneeland et al. | |
| 2011/0052413 | A1 | 3/2011 | Kwon et al. | |
| 2013/0017095 | A1 | 1/2013 | Lee et al. | |

OTHER PUBLICATIONS

Extended European Search Report cited in EP Application No. 12187836.7-1610, dated Mar. 4, 2013, pp. 1-7.

Extended European Search Report for EP Application No. 12189881.1-1610, dated May 13, 2014, pp. 1-6.

* cited by examiner

TURBINE OF A TURBOMACHINE

BACKGROUND OF THE INVENTION

The subject matter disclosed herein relates to a turbomachine and, more particularly, to a turbomachine having airfoil throat distributions producing a tip strong pressure profile in a fluid flow.

A turbomachine, such as a gas turbine engine, may include a compressor, a combustor and a turbine. The compressor compresses inlet gas and the combustor combusts the compressed inlet gas along with fuel to produce high temperature fluids. Those high temperature fluids are directed to the turbine where the energy of the high temperature fluids is converted into mechanical energy that can be used to generate power and/or electricity. The turbine is formed to define an annular pathway through which the high temperature fluids pass.

The energy conversion in the turbine may be achieved by a series of blade and nozzle stages disposed along the pathway. Aerodynamic properties in a root region of the last stage are typically limited when a radial throat distribution is chosen to achieve a flat turbine exit profile. Specifically, root convergence may be relatively low and the performance in the root region may suffer as a result.

BRIEF DESCRIPTION OF THE INVENTION

According to one aspect of the invention, a turbine of a turbomachine is provided and includes opposing endwalls defining a pathway for a fluid flow and a plurality of interleaved blade stages and nozzle stages arranged axially along the pathway. The plurality of the blade stages includes a last blade stage at a downstream end of the pathway and a next-to-last blade stage upstream from the last blade stage. The plurality of the nozzle stages includes a last nozzle stage between the last blade stage and the next-to-last blade stage and a next-to-last nozzle stage upstream from the next-to-last blade stage. At least one of the next-to-last blade stage and the next-to-last nozzle stage includes aerodynamic elements configured to interact with the fluid flow and to define a throat distribution producing a tip strong pressure profile in the fluid flow.

According to another aspect of the invention, a turbine of a turbomachine is provided and includes opposing endwalls defining a pathway for a fluid flow and a plurality of interleaved blade stages and nozzle stages arranged axially along the pathway. The plurality of the blade stages includes a last blade stage at a downstream end of the pathway and a next-to-last blade stage upstream from the last blade stage. The plurality of the nozzle stages includes a last nozzle stage between the last blade stage and the next-to-last blade stage and a next-to-last nozzle stage upstream from the next-to-last blade stage. The next-to-last blade stage includes aerodynamic elements configured to interact with the fluid flow and to define a throat distribution producing a tip strong pressure profile in the fluid flow.

According to another aspect of the invention, a turbomachine is provided and includes a compressor to compress inlet gas to produce compressed inlet gas, a combustor to combust the compressed inlet gas along with fuel to produce a fluid flow and a turbine receptive of the fluid flow and comprising opposing endwalls defining a pathway for the fluid flow and a plurality of interleaved blade stages and nozzle stages arranged axially along the pathway. The plurality of the blade stages includes a next-to-last blade stage and a last blade stage sequentially disposed along the pathway. The plurality of the nozzle stages includes a next-to-last nozzle stage and a last nozzle stage sequentially disposed along the pathway. At least one of the next-to-last blade stage and the next-to-last nozzle stage includes aerodynamic elements configured to interact with the fluid flow and to define a throat distribution producing a tip strong pressure profile in the fluid flow.

According to yet another aspect of the invention, a turbine of a turbomachine is provided and includes opposing endwalls defining a pathway for a fluid flow and a plurality of interleaved blade stages and nozzle stages arranged axially along the pathway. The plurality of the blade stages include a last blade stage at a downstream end of the pathway and a next-to-last blade stage upstream from the last blade stage, and the plurality of the nozzle stages include a last nozzle stage between the last blade stage and the next-to-last blade stage and a next-to-last nozzle stage upstream from the next-to-last blade stage. The last blade stage and the last nozzle stage include aerodynamic elements configured to achieve a substantially flat exit pressure profile.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
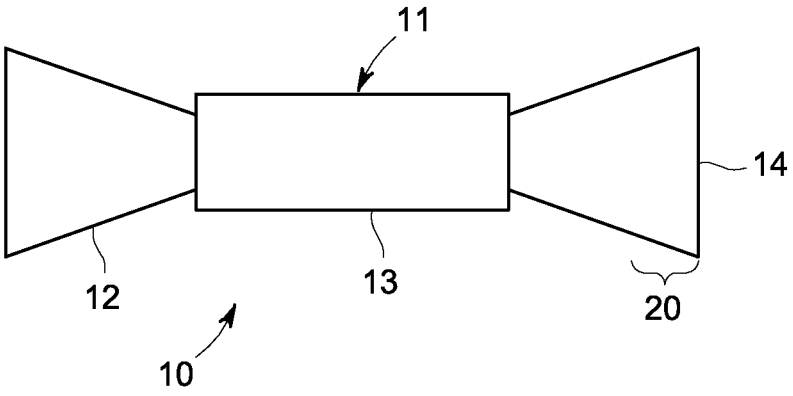
FIG. 1 is a schematic diagram of a gas turbine engine.
Figure 2:
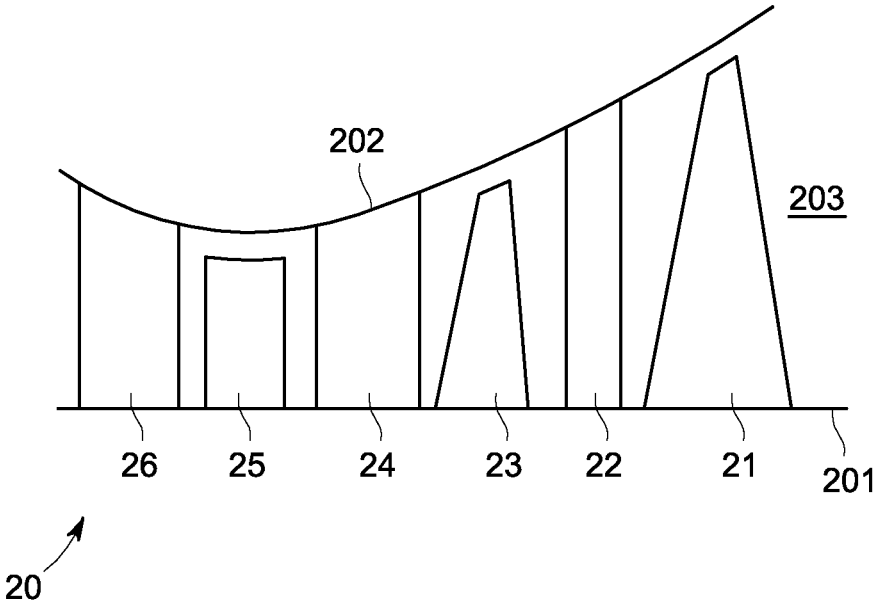
FIG. 2 is a side of an interior of a turbine of the gas turbine engine of FIG. 1.

With reference to FIGS. 1 and 2 and, in accordance with aspects of the invention, a turbomachine 10 is provided as, for example, a gas turbine engine 11. As such, the turbomachine 10 may include a compressor 12, a combustor 13 and a turbine 14. The compressor 12 compresses inlet gas and the combustor 13 combusts the compressed inlet gas along with fuel to produce high temperature fluids. Those high temperature fluids are directed to the turbine 14 where the energy of the high temperature fluids is converted into mechanical energy that can be used to generate power and/or electricity.

The turbine 14 includes a first annular endwall 201 and a second annular endwall 202, which is disposed about the first annular endwall 201 to define an annular pathway 203. The annular pathway 203 extends from an upstream section thereof, which is proximate to the combustor 13, to a downstream section thereof, which is remote from the combustor 13. That is, the high temperature fluids are output from the combustor 13 and pass through the turbine 14 along the pathway 203 from the upstream section to the downstream section.

At a portion 20 of the turbine, the turbine 14 includes a plurality of interleaved blade and nozzle stages. The blade stages may include last blade stage 21, which may be disposed proximate to an axially downstream end of the pathway 203, next-to-last blade stage 23, which may be disposed upstream from the last blade stage 21, and one or more upstream blade stages 25, which may be disposed upstream from the next-to-last blade stage 23. The nozzles stages may include last nozzle stage 22, which is disposed axially between the last blade stage 21 and the next-to-last blade stage 23, next-to-last nozzle stage 24, which may be disposed upstream from the next-to-last blade stage 23, and one or more upstream nozzles stages 26, which may be disposed upstream from the one or more upstream blade stages 25.

The last blade stage 21 includes an annular array of a first type of aerodynamic elements (hereinafter referred to as "blades"), which are provided such that each blade is extendible across the pathway 203 and between the first and second endwalls 201 and 202. The next-to-last blade stage 23 and the one or more upstream blade stages 25 are similarly configured. The last nozzle stage 22 includes an annular array of a second type of aerodynamic elements (hereinafter referred to as "nozzles"), which are provided such that each nozzle is extendible across the pathway 203 and between the first and second endwalls 201 and 202. The next-to-last nozzle stage 24 and the one or more upstream nozzle stages 26 are similarly configured.

Each of the blades and the nozzles may have an airfoil shape with a leading edge, a trailing edge that opposes the leading edge, a pressure side extending between the leading edge and the trailing edge and a suction side opposing the pressure side and extending between the leading edge and the trailing edge. Each of the blades and nozzles may be disposed such that a pressure side of any one of the blades and nozzles faces a suction side of an adjacent one of the blades and nozzles, respectively, within a given stage. With this configuration, as the high temperature fluids flow through the pathway 203, the high temperature fluids aerodynamically interact with the blades and nozzles and are forced to flow with an angular momentum relative to a centerline of the turbine 14 that causes the last blade stage 21, the next-to-last blade stage 23 and the one or more upstream blade stages 25 to rotate about the centerline.

In general, a throat is defined as a narrowest region between adjacent nozzles or blades in a given stage. A radial throat distribution, then, is representative of throat measurements of adjacent nozzles or blades in a given stage at various span (i.e., radial) locations. Normally, aerodynamic properties in root regions of blades of the last blade stage 21, which are proximate to the first endwall 201, are typically limited when a radial throat distribution is chosen to achieve a flat turbine exit profile. In particular, root convergence may be relatively low and blade stage performance in the root region may suffer as a result. However, in accordance with aspect, inlet profiles to the last blade stage 21 can be biased to be tip strong such that a design space of the blades at the last blade stage 21 is opened to achieve a substantially flat exit pressure profile without the expense of poor root region aerodynamics.

This is achieved by choosing radial throat distributions of adjacent aerodynamic elements of at least one of the next-to-last blade stage 23 and the next-to-last nozzle stage 24 such that radial work distribution produces a tip strong total pressure profile exiting the next-to-last blade stage 23 and the next-to-last nozzle stage 24. In doing so, the fluid flow is conditioned by the next-to-last blade stage 23 and the next-to-last nozzle stage 24 as the fluid flow continues to proceed toward the last blade stage 21 and the last nozzle stage 22.

Although it is to be understood that the choosing of the radial throat distributions can relate to the next-to-last blade stage 23 and/or the next-to-last nozzle stage 24, for purposes of clarity and brevity the choosing of the radial throat distribution of only the next-to-last blade stage 23 will be described in detail.

Figure 3:
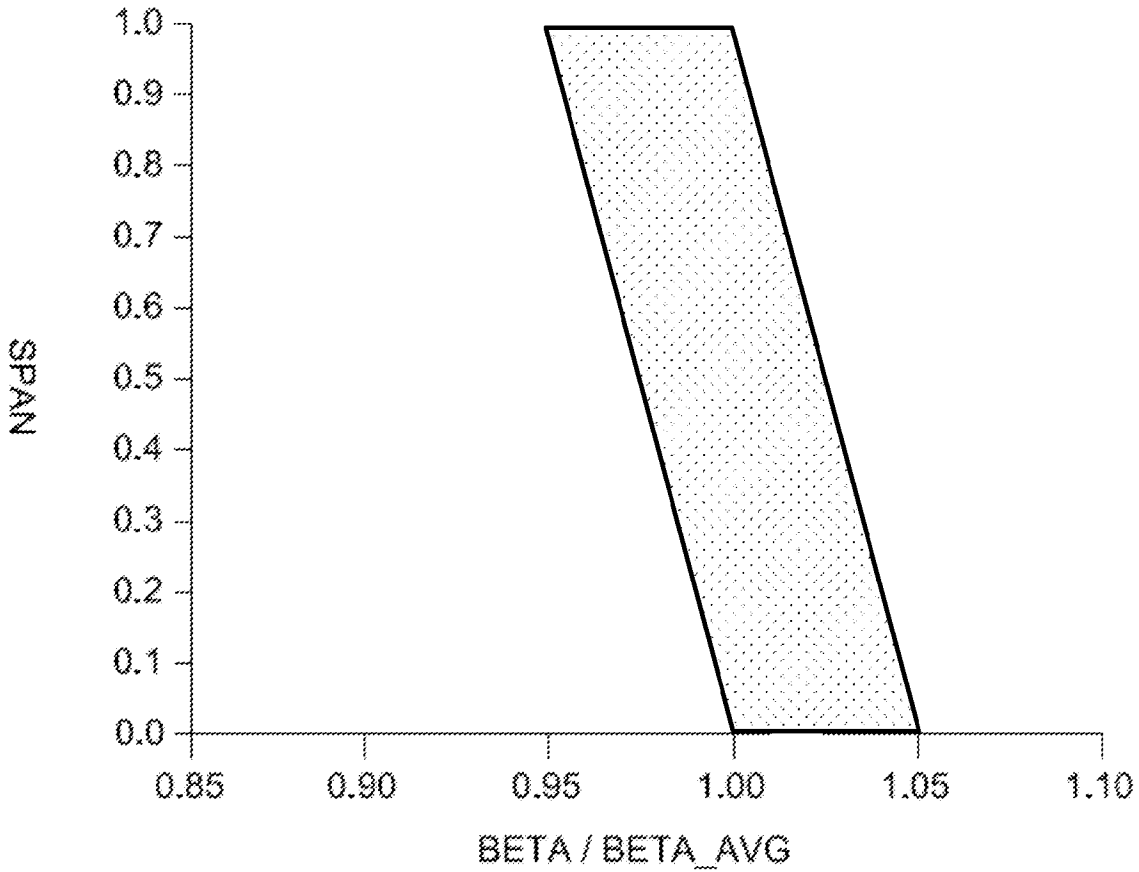
FIG. 3 is a graphical illustration of a non-dimensional relative exit angle distribution range in accordance with embodiments.

As shown in FIG. 3, the radial throat distribution is a circumferentially averaged profile that, when chosen as described herein, exhibits a non-dimensional, relative exit angle distribution ranging from between 1.00 and 1.05 at or proximate to the first endwall 201 to between 0.95 and 1.00 at or proximate to the second endwall 202. This relatively strong forced vortexing scheme opens the design space of both the last nozzle stage 22 and the last blade stage 21 where a flat turbine exit total pressure profile to the diffuser is targeted to thereby improve the stage performance of at least the last blade stage 21 for a given flat exit total pressure distribution target. The flat inlet profile to a diffuser downstream from the turbine 14 may be chosen for diffuser recovery and minimal peak velocity to heat recovery steam generator (HRSG) systems.

In accordance with embodiments of the invention, adjacent nozzles of the last nozzle stage 22 may be arranged to exhibit the following exemplary non-dimensional characteristics:

| Span | Throat |
|---|---|
| 100 | 1.29 ± 10% |
| 92.2 | 1.26 ± 10% |
| 76.0 | 1.16 ± 10% |
| 58.4 | 1.04 ± 10% |
| 38.6 | 0.90 ± 10% |
| 14.8 | 0.73 ± 10% |
| 0.0 | 0.61 ± 10% |

In accordance with embodiments of the invention, adjacent blades of the last blade stage 21 may be arranged to exhibit the following exemplary non-dimensional characteristics:

| Span | Throat |
|---|---|
| 100 | 1.13 ± 10% |
| 91.9 | 1.12 ± 10% |
| 75.7 | 1.09 ± 10% |
| 58.3 | 1.06 ± 10% |
| 38.7 | 0.98 ± 10% |
| 15.1 | 0.85 ± 10% width |
| 0.0 | 0.76 ± 10% width |

In accordance with embodiments of the invention, adjacent nozzles of the next-to-last nozzle stage 24 may be arranged to exhibit the following exemplary non-dimensional characteristics:

| Span | Throat |
|---|---|
| 100 | 1.20 ± 10% |
| 90.0 | 1.16 ± 10% |
| 70.0 | 1.08 ± 10% |
| 50.0 | 1.00 ± 10% |
| 30.0 | 0.92 ± 10% |
| 10.0 | 0.84 ± 10% |
| 0.0 | 0.81 ± 10% |

In accordance with embodiments of the invention, adjacent blades of the next-to-last blade stage 23 may be arranged to exhibit the following exemplary non-dimensional characteristics:

| Span | Throat |
|---|---|
| 100 | 1.18 ± 10% |
| 90.0 | 1.15 ± 10% |
| 70.0 | 1.08 ± 10% |
| 50.0 | 1.01 ± 10% |
| 30.0 | 0.93 ± 10% |
| 10.0 | 0.85 ± 10% |
| 0.0 | 0.80 ± 10% |

Figure 4:
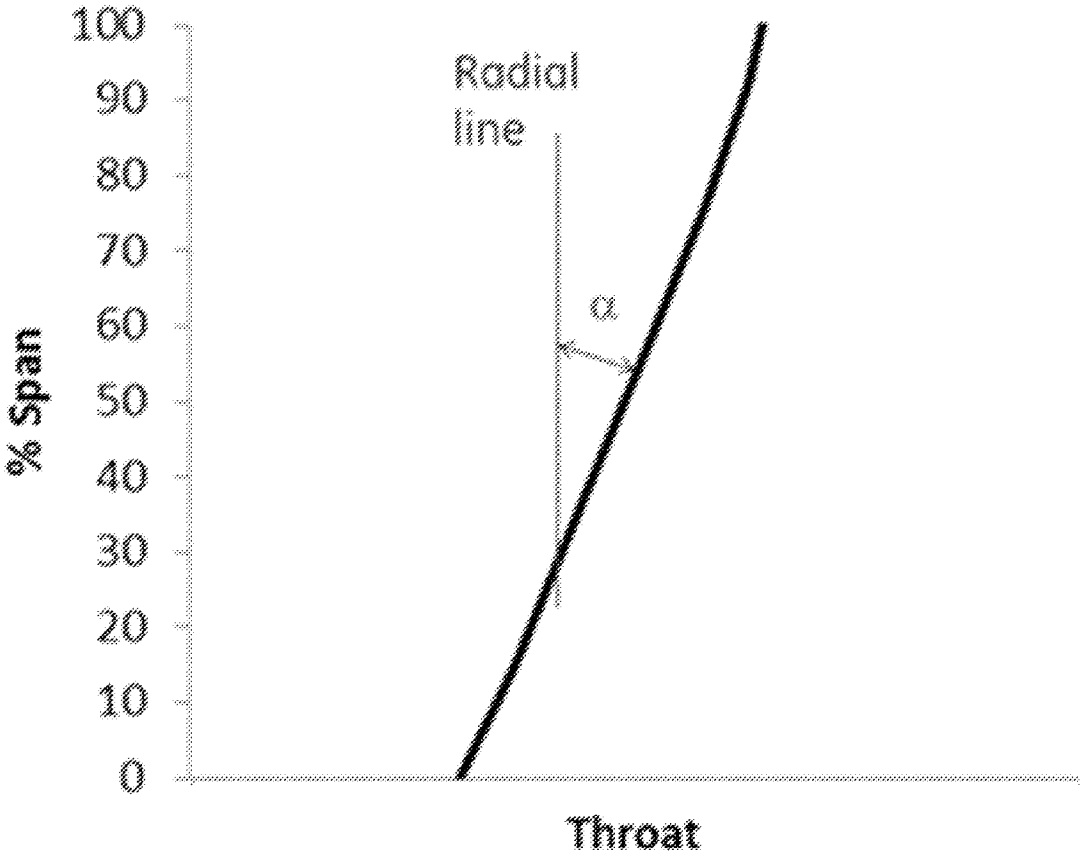
FIG. 4 is a graphical illustration of the throat distribution of next-to-last or last blade or nozzle stages according to exemplary embodiments of the present subject matter.

As illustrated in FIG. 4, the foregoing characteristics of adjacent blades or nozzles of next-to-last and last blade or nozzle stages may be represented graphically as a plot of throat versus span. As shown in FIG. 4, in exemplary embodiments of the present subject matter, the throat distribution increases along the entire span of the blades or nozzles.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine of a turbomachine, comprising:

opposing first and second endwalls defining a pathway for a fluid flow; and a plurality of interleaved blade stages and nozzle stages arranged axially along the pathway, the plurality of the blade stages including a last blade stage at a downstream end of the pathway and a next-to-last blade stage upstream from the last blade stage, the plurality of the nozzle stages including a last nozzle stage between the last blade stage and the next-to-last blade stage and a next-to-last nozzle stage upstream from the next-to-last blade stage, and at least one of the next-to-last blade stage and the next-to-last nozzle stage including aerodynamic elements configured to interact with the fluid flow and to define a throat distribution as a radial throat distribution that is a circumferentially averaged profile that exhibits a non-dimensional relative exit angle distribution ranging from between 1.00 and 1.05 at the first endwall to between 0.95 and 1.00 at the second endwall, wherein adjacent blades of the next-to-last blade stage are arranged such that the throat distribution increases along an entire span of the blades and adjacent nozzles of the next-to-last nozzle stage are arranged such that the throat distribution increases along an entire span of the nozzles.

2. The turbine according to claim 1, wherein the fluid flow comprises a flow of high temperature fluids produced by combustion.

3. The turbine according to claim 1, wherein each blade stage of the plurality of the blade stages comprises an annular array of blades that extend through the pathway between the opposing first and second endwalls.

4. The turbine according to claim 1, wherein each nozzle stage of the plurality of the nozzle stages comprises an annular array of nozzles that extend through the pathway between the opposing first and second endwalls.

5. The turbine according to claim 1, wherein the aerodynamic elements of at least the next-to-last blade stage comprise adjacent aerodynamic elements.

6. The turbine according to claim 1, wherein at least one of the last blade stage and the last nozzle stage includes adjacent aerodynamic elements.

7. A turbine of a turbomachine, comprising:

opposing first and second endwalls defining a pathway for a fluid flow; and a plurality of interleaved blade stages and nozzle stages arranged axially along the pathway, the plurality of the blade stages including a last blade stage at a downstream end of the pathway and a next-to-last blade stage upstream from the last blade stage, the plurality of the nozzle stages including a last nozzle stage between the last blade stage and the next-to-last blade stage and a next-to-last nozzle stage upstream from the next-to-last blade stage, and the next-to-last blade stage including aerodynamic elements configured to interact with the fluid flow and to define a throat distribution as a radial throat distribution that is a circumferentially averaged profile that exhibits a non-dimensional relative exit angle distribution ranging from between 1.00 and 1.05 at the first endwall to between 0.95 and 1.00 at the second endwall, wherein adjacent blades of the next-to-last blade stage are arranged such that the throat distribution increases along an entire span of the blades.

8. The turbine according to claim 7, wherein the fluid flow comprises a flow of high temperature fluids produced by combustion.

9. The turbine according to claim 7, wherein each blade stage of the plurality of the blade stages comprises an annular array of blades that extend through the pathway between the opposing first and second endwalls.

10. The turbine according to claim 7, wherein each nozzle stage of the plurality of the nozzle stages comprises an annular array of nozzles that extend through the pathway between the opposing first and second endwalls.

11. The turbine according to claim 7, wherein the aerodynamic elements of at least the next-to-last blade stage comprise adjacent aerodynamic elements.

12. The turbine according to claim 7, wherein at least one of the last blade stage and the last nozzle stage includes adjacent aerodynamic elements.

13. A turbomachine, comprising:

a compressor to compress inlet gas to produce compressed inlet gas;

a combustor to combust the compressed inlet gas along with fuel to produce a fluid flow; and a turbine receptive of the fluid flow and comprising opposing first and second endwalls defining a pathway for the fluid flow and a plurality of interleaved blade stages and nozzle stages arranged axially along the pathway, the plurality of the blade stages including a next-to-last blade stage and a last blade stage sequentially disposed along the pathway, the plurality of the nozzle stages including a next-to-last nozzle stage and a last nozzle stage sequentially disposed along the pathway, and at least one of the next-to-last blade stage and the next-to-last nozzle stage including aerodynamic elements configured to interact with the fluid flow and to define a throat distribution as a radial throat distribution that is a circumferentially averaged profile that exhibits a non-dimensional relative exit angle distribution ranging from between 1.00 and 1.05 at the first endwall to between 0.95 and 1.00 at the second endwall, wherein adjacent blades of the next-to-last blade stage are arranged such that the throat distribution increases along an entire span of the blades and adjacent nozzles of the next-to-last nozzle stage are arranged such that the throat distribution increases along an entire span of the nozzles.

14. The turbomachine according to claim 13, wherein the fluid flow comprises a flow of high temperature fluids produced by combustion within the combustor.

15. The turbomachine according to claim 13, wherein each blade stage of the plurality of the blade stages comprises an annular array of blades that extend through the pathway between the opposing first and second endwalls.

16. The turbomachine according to claim 13, wherein each nozzle stage of the plurality of the nozzle stages comprises an annular array of nozzles that extend through the pathway between the opposing first and second endwalls.

17. The turbomachine according to claim 13, wherein the aerodynamic elements of at least the next-to-last blade stage comprise adjacent aerodynamic elements.

18. The turbomachine according to claim 13, wherein at least one of the last blade stage and the last nozzle stage includes adjacent aerodynamic elements.

19. A turbine of a turbomachine, comprising:

opposing first and second endwalls defining a pathway for a fluid flow; and a plurality of interleaved blade stages and nozzle stages arranged axially along the pathway, the plurality of the blade stages including a last blade stage at a downstream end of the pathway and a next-to-last blade stage upstream from the last blade stage, the plurality of the nozzle stages including a last nozzle stage between the last blade stage and the next-to-last blade stage and a next-to-last nozzle stage upstream from the next-to-last blade stage, and the last blade stage and the last nozzle stage including aerodynamic elements configured to define a throat distribution as a radial throat distribution that is a circumferentially averaged profile that exhibits a non-dimensional relative exit angle distribution ranging from between 1.00 and 1.05 at the first endwall to between 0.95 and 1.00 at the second endwall, wherein adjacent blades of the last blade stage are arranged such that the throat distribution increases along an entire span of the blades and adjacent nozzles of the last nozzle stage are arranged such that the throat distribution increases along an entire span of the nozzles.

* * * * *